US009240148B2

(12) United States Patent
Saigo

(10) Patent No.: US 9,240,148 B2
(45) Date of Patent: Jan. 19, 2016

(54) IMAGE PROCESSING DEVICE, DISPLAY DEVICE, AND IMAGE PROCESSING METHOD

(71) Applicant: SEIKO EPSON CORPORATION, Tokyo (JP)

(72) Inventor: Manabu Saigo, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 363 days.

(21) Appl. No.: 13/944,412

(22) Filed: Jul. 17, 2013

(65) Prior Publication Data

US 2014/0022290 A1 Jan. 23, 2014

(30) Foreign Application Priority Data

Jul. 23, 2012 (JP) ..... 2012-162385

(51) Int. Cl.

| | |
|---|---|
| ***G09G 3/36*** | (2006.01) |
| ***G09G 3/20*** | (2006.01) |
| ***G09G 3/00*** | (2006.01) |
| ***G09G 5/02*** | (2006.01) |
| ***G09G 5/06*** | (2006.01) |

(52) U.S. Cl.

CPC ..... *G09G 3/3607* (2013.01); *G09G 3/002* (2013.01); *G09G 3/2003* (2013.01); *G09G 5/02* (2013.01); *G09G 5/06* (2013.01); *G09G 2300/0452* (2013.01); *G09G 2310/027* (2013.01); *G09G 2310/0297* (2013.01); *G09G 2340/06* (2013.01)

(58) Field of Classification Search

CPC ... G09G 3/002; G09G 3/2003; G09G 3/3607; G09G 5/02; G09G 5/06; G09G 2310/027; G09G 2310/0297; G09G 2300/0452; G09G 2340/06

See application file for complete search history.

(56) References Cited

U.S. PATENT DOCUMENTS

| | | | | |
|---|---|---|---|---|
| 6,633,302 | B1 | 10/2003 | Ohsawa et al. | |
| 2005/0088385 | A1* | 4/2005 | Elliott | G06T 3/4007 345/87 |
| 2006/0132660 | A1 | 6/2006 | Kurumisawa | |
| 2007/0257944 | A1* | 11/2007 | Miller | G09G 3/3225 345/694 |
| 2007/0279372 | A1* | 12/2007 | Brown Elliott | G09G 3/3426 345/102 |
| 2008/0266318 | A1* | 10/2008 | Peeters | G09G 3/3607 345/603 |
| 2009/0058873 | A1* | 3/2009 | Brown Elliott | G06T 5/009 345/589 |
| 2010/0231603 | A1* | 9/2010 | Kang | G09G 3/3426 345/591 |
| 2010/0259569 | A1* | 10/2010 | Inuzuka | G09G 3/3611 345/690 |
| 2012/0194578 | A1* | 8/2012 | Znamenskiy | G09G 3/3413 345/694 |
| 2013/0021227 | A1* | 1/2013 | Saigo | G09G 5/02 345/55 |

FOREIGN PATENT DOCUMENTS

| | | |
|---|---|---|
| JP | A-7-6703 | 1/1995 |
| JP | A-2000-338950 | 12/2000 |
| JP | A-2006-267541 | 10/2006 |

* cited by examiner

*Primary Examiner* — Kathy Wang-Hurst
*Assistant Examiner* — David Tung
(74) *Attorney, Agent, or Firm* — Oliff PLC

(57) ABSTRACT

An image processing device is capable of inhibiting the moire and the false color from occurring in the case of performing color display using four colors of sub-pixels. The image processing device has filter processing sections. The filter processing sections limit frequency bands of signals R, G, B, and W in an X direction and a Y direction in accordance with a positional relationship between the sub-pixels corresponding to each of the colors and the other sub-pixels. Further, the filter processing sections control a frequency response of image signals of the respective colors in accordance with an amplitude of a high frequency component of the image signal corresponding to each of the other colors.

10 Claims, 11 Drawing Sheets

| | |
|---|---|
| B | G |
| W | R |

FIG.13A

| | |
|---|---|
| R | W |
| G | B |

FIG.13B

| | |
|---|---|
| W | B |
| R | G |

FIG.13C

| | |
|---|---|
| B | W |
| G | R |

FIG.13D

IMAGE PROCESSING DEVICE, DISPLAY DEVICE, AND IMAGE PROCESSING METHOD

The entire disclosure of Japanese Patent Application No. 2012-162385, filed Jul. 23, 2012, is expressly incorporated by reference herein.

BACKGROUND

1. Technical Field

The present invention relates to image processing performed in the case of performing color display using four colors of sub-pixels.

2. Related Art

As an arrangement of pixels in a display device using three primary colors, there can be cited a stripe arrangement and a delta arrangement (see, e.g., JP-A-07-006703 (Document 1)). In such a display device, each pixel is composed of three sub-pixels. Besides these arrangements, there is known the Bayer arrangement. In the Bayer arrangement, one pixel is composed of totally four sub-pixels arranged 2×2 including two G (green) sub-pixels, one R (red) sub-pixel, and one B (blue) sub-pixel.

In the display device using the Bayer arrangement, color display is generally performed using image data with the number of pixels a quarter of the number of pixels of image data input thereto. In this case, the resolution of the image data used actually is lower than the resolution of the image data input thereto. Therefore, in order to suppress the moire caused by folding noise, a filter process for limiting a frequency band of an image signal is performed. For example, in the case of R and B image signals, in order for preventing moire caused by a high-frequency component, it is necessary to limit the frequency band of both of the vertical and lateral directions to a half (i.e., ½) thereof. It should be noted that since a G image signal has twice as many sub-pixels as the R or B image signal, the limitation range of the band can be smaller than those of the R and B image signals.

There is a case in which the color display is performed using four primary colors (or more primary colors) for the purpose of improvement of color reproducibility and brightness. For example, JP-A-2006-267541 (Document 2) discloses an image display device having either one of the G sub-pixels in the Bayer arrangement replaced with a white (W) or a cyan (C) sub-pixel to thereby perform the color display with four colors of sub-pixels. Further, JP-A-2000-338950 (Document 3) discloses a technology for calculating color image signals of the respective colors in the case of having a color display section of four or more primary colors. It should be noted that the "primary color" mentioned here denotes the color forming a base of the color mixture (an additive process), and is not limited to the light's three primary colors.

In the case of performing the color display using the four colors of sub-pixels, if the band of the image signal is limited independently color by color, moire or false color may occur in some cases.

SUMMARY

An advantage of the invention is to provide a technology for inhibiting the moire and the false color from occurring in the case of performing the color display using the four colors of sub-pixels.

An image processing device according to an aspect of the invention includes an output section adapted to output an image signal to a display device having a plurality of pixels each including four sub-pixels constituted by a first sub-pixel, a second sub-pixel, a third sub-pixel, and a fourth sub-pixel corresponding respectively to a first color, a second color, a third color, and a fourth color different from each other, the first and second sub-pixels being adjacent to each other in a first direction, the second and third sub-pixels being adjacent to each other in a second direction intersecting with the first direction, the third and fourth sub-pixels being adjacent to each other in the first direction, the fourth and first sub-pixels being adjacent to each other in the second direction, and the first color including components of the second, third, and fourth colors, a first filter section adapted to limit frequency bands in the first and second directions of a first image signal corresponding to the first color in each of the pixels in accordance with a positional relationship between the first and third sub-pixels, and adjust a frequency response of the first image signal in accordance with amplitudes of high-frequency components of image signals corresponding respectively to the second, third, and fourth colors, and amplitudes of the second, third, and fourth color components of a high-frequency component of the first image signal, a second filter section adapted to limit frequency bands in the first and second directions of a second image signal representing a grayscale value of the second sub-pixel in each of the pixels in accordance with a positional relationship between the first and second sub-pixels, and adjust a frequency response of the second image signal in accordance with the amplitudes of the high-frequency components of the image signals corresponding respectively to the second, third, and fourth colors, and the amplitudes of the second, third, and fourth color components of the high-frequency component of the first image signal, a third filter section adapted to limit frequency bands in the first and second directions of a third image signal representing a grayscale value of the third sub-pixel in each of the pixels in accordance with the positional relationship between the first and third sub-pixels, and adjust a frequency response of the third image signal in accordance with the amplitudes of the high-frequency components of the image signals corresponding respectively to the second, third, and fourth colors, and the amplitudes of the second, third, and fourth color components of the high-frequency component of the first image signal, and a fourth filter section adapted to limit frequency bands in the first and second directions of a fourth image signal representing a grayscale value of the fourth sub-pixel in each of the pixels in accordance with a positional relationship between the first and fourth sub-pixels, and adjust a frequency response of the fourth image signal in accordance with the amplitudes of the high-frequency components of the image signals corresponding respectively to the second, third, and fourth colors, and the amplitudes of the second, third, and fourth color components of the high-frequency component of the first image signal, and the first, second, third, and fourth filter sections have a frequency response in common in a predetermined low-frequency band in each of the first and second directions.

According to the image processing device of this aspect of the invention, the moire and the false color can be inhibited from occurring in the case of performing the color display with four colors of sub-pixels compared to the case of performing filter processes independent of each other for the respective colors.

The image processing device of the aspect of the invention may be configured such that the second filter section adjusts the frequency response of the second image signal so as to be different between the first direction and the second direction in a high-frequency band.

According to the image processing device of this configuration, the moire and the false color caused by the second image signal can be inhibited from occurring in the case of performing the color display with four colors of sub-pixels compared to the case in which the frequency response is the same between the first and second directions.

The image processing device of the aspect of the invention may be configured such that the second filter section adjusts the frequency response of the second image signal so as to be positive in the high-frequency band in the first direction, and negative in the high-frequency band in the second direction.

According to the image processing device of this configuration, the moire and the false color caused by the second image signal can be inhibited from occurring in the case of performing the color display with four colors of sub-pixels compared to the case in which the polarity of the frequency response is the same between the first and second directions.

The image processing device of the aspect of the invention may be configured such that the fourth filter section adjusts the frequency response of the fourth image signal so as to be different between the first direction and the second direction in a high-frequency band.

According to the image processing device of this configuration, the moire and the false color caused by the fourth image signal can be inhibited from occurring in the case of performing the color display with four colors of sub-pixels compared to the case in which the frequency response is the same between the first and second directions.

The image processing device of the aspect of the invention may be configured such that the fourth filter section adjusts the frequency response of the fourth image signal so as to be negative in the high-frequency band in the first direction, and positive in the high-frequency band in the second direction.

According to the image processing device of this configuration, the moire and the false color caused by the fourth image signal can be inhibited from occurring in the case of performing the color display with four colors of sub-pixels compared to the case in which the polarity of the frequency response is the same between the first and second directions.

The image processing device of the aspect of the invention may be configured such that the first filter section adjusts the frequency response of the first image signal so as to be +H1 in a high-frequency band in the first and second directions, the second filter section adjusts the frequency response of the second image signal so as to be +H2 in a high-frequency band in the first direction, and −H2 in the high-frequency band in the second direction, the third filter section adjusts the frequency response of the third image signal so as to be +H3 in a high-frequency band in the first and second directions, the fourth filter section adjusts the frequency response of the fourth image signal so as to be −H4 in the high-frequency band in the first direction, and +H4 in the high-frequency band in the second direction, H1, H2, H3, and H4 are determined by Formula (1).

$$H1=1/\mathrm{Max}(R2,R3,R4,1)$$

$$H2=R2/\mathrm{Max}(R2,R3,R4,1)$$

$$H3=R3/\mathrm{Max}(R2,R3,R4,1)$$

$$H4=R4/\mathrm{Max}(R2,R3,R4,1) \quad (1)$$

In the formula, R2, R3, and R4 are parameters determined by Formula (2).

$$R2A21/A2$$

$$R3=A31/A3$$

$$R4=A41/A4 \quad (2)$$

In the formula, A2, A3, and A4 respectively represent the amplitudes in a high-frequency band of the second, third, and fourth colors, and A21, A31, and A41 respectively represent the amplitudes of the second, third, and fourth color components of the first color.

According to the image processing device of this configuration, the moire and the false color can be inhibited from occurring compared to the case of not adjusting the frequency response in accordance with the smallest one of the amplitudes of a plurality of color components.

The image processing device of the aspect of the invention may be configured such that the amplitudes of the high-frequency components are each an amplitude at a frequency of 2 pixels/cycle.

According to the image processing device of this configuration, the frequency response can be adjusted using the amplitude at the highest frequency.

The image processing device of the aspect of the invention may be configured such that the common frequency response can be 1.

According to the image processing device of this configuration, the luminance in the low-frequency band can be increased compared to the case in which the common frequency response is smaller than 1.

A display device according to another aspect of the invention includes a display section having a plurality of pixels each including four sub-pixels constituted by a first sub-pixel, a second sub-pixel, a third sub-pixel, and a fourth sub-pixel corresponding respectively to a first color, a second color, a third color, and a fourth color different from each other, the first and second sub-pixels being adjacent to each other in a first direction, the second and third sub-pixels being adjacent to each other in a second direction intersecting with the first direction, the third and fourth sub-pixels being adjacent to each other in the first direction, the fourth and first sub-pixels being adjacent to each other in the second direction, and the first color including components of the second, third, and fourth colors, an output section adapted to output an image signal to the display section, a first filter section adapted to limit frequency bands in the first and second directions of a first image signal corresponding to the first color in each of the pixels in accordance with a positional relationship between the first and third sub-pixels, and adjust a frequency response of the first image signal in accordance with amplitudes of high-frequency components of image signals corresponding respectively to the second, third, and fourth colors, and amplitudes of the second, third, and fourth color components of a high-frequency component of the first image signal, a second filter section adapted to limit frequency bands in the first and second directions of a second image signal representing a grayscale value of the second sub-pixel in each of the pixels in accordance with a positional relationship between the first and second sub-pixels, and adjust a frequency response of the second image signal in accordance with the amplitudes of the high-frequency components of the image signals corresponding respectively to the second, third, and fourth colors, and the amplitudes of the second, third, and fourth color components of the high-frequency component of the first image signal, a third filter section adapted to limit frequency bands in the first and second directions of a third image signal representing a grayscale value of the third sub-pixel in each of the pixels in accordance with the positional relationship between the first and third sub-pixels, and adjust a frequency response of the third image signal in accordance with the amplitudes of the high-frequency components of the image signals corresponding respectively to the second, third, and fourth colors, and the amplitudes of the second, third, and fourth color components of the high-frequency component of the first image signal, and a fourth filter section adapted to limit frequency bands in the first and second directions of a fourth image signal representing a grayscale value of the fourth sub-pixel in each of the pixels in accordance with a positional relationship between the first and fourth sub-pixels, and adjust a frequency response of the fourth image signal in accordance with the amplitudes of the high-frequency components of the image signals corresponding respectively to the second, third, and fourth colors, and the amplitudes of the second, third, and fourth color components of the high-frequency component of the first image signal, and the first, second, third, and fourth filter sections have a frequency response in common in a predetermined low-frequency band in each of the first and second directions.

According to the display device of this aspect of the invention, the moire and the false color can be inhibited from occurring in the case of performing the color display with four colors of sub-pixels compared to the case of performing the filter processes independent of each other for the respective colors.

An image processing method according to still another aspect of the invention includes: outputting, by an output section, an image signal to a display device having a plurality of pixels each including four sub-pixels constituted by a first sub-pixel, a second sub-pixel, a third sub-pixel, and a fourth sub-pixel corresponding respectively to a first color, a second color, a third color, and a fourth color different from each other, the first and second sub-pixels being adjacent to each other in a first direction, the second and third sub-pixels being adjacent to each other in a second direction intersecting with the first direction, the third and fourth sub-pixels being adjacent to each other in the first direction, the fourth and first sub-pixels being adjacent to each other in the second direction, and the first color including components of the second, third, and fourth colors, limiting, by a first filter section, frequency bands in the first and second directions of a first image signal corresponding to the first color in each of the pixels in accordance with a positional relationship between the first and third sub-pixels, and adjusting a frequency response of the first image signal in accordance with amplitudes of high-frequency components of image signals corresponding respectively to the second, third, and fourth colors, and amplitudes of the second, third, and fourth color components of a high-frequency component of the first image signal, limiting, by a second filter section, frequency bands in the first and second directions of a second image signal representing a grayscale value of the second sub-pixel in each of the pixels in accordance with a positional relationship between the first and second sub-pixels, and adjusting a frequency response of the second image signal in accordance with the amplitudes of the high-frequency components of the image signals corresponding respectively to the second, third, and fourth colors, and the amplitudes of the second, third, and fourth color components of the high-frequency component of the first image signal, limiting, by a third filter section, frequency bands in the first and second directions of a third image signal representing a grayscale value of the third sub-pixel in each of the pixels in accordance with the positional relationship between the first and third sub-pixels, and adjusting a frequency response of the third image signal in accordance with the amplitudes of the high-frequency components of the image signals corresponding respectively to the second, third, and fourth colors, and the amplitudes of the second, third, and fourth color components of the high-frequency component of the first image signal, and limiting, by a fourth filter section, frequency bands in the first and second directions of a fourth image signal representing a grayscale value of the fourth sub-pixel in each of the pixels in accordance with a positional relationship between the first and fourth sub-pixels, and adjusting a frequency response of the fourth image signal in accordance with the amplitudes of the high-frequency components of the image signals corresponding respectively to the second, third, and fourth colors, and the amplitudes of the second, third, and fourth color components of the high-frequency component of the first image signal, and the first, second, third, and fourth filter sections have a frequency response in common in a predetermined low-frequency band in each of the first and second directions.

According to the image processing method of this aspect of the invention, the moire and the false color can be inhibited from occurring in the case of performing the color display with four colors of sub-pixels compared to the case of performing the filter processes independent of each other for the respective colors.

BRIEF DESCRIPTION OF THE DRAWINGS

The invention will be described with reference to the accompanying drawings, wherein like numbers reference like elements.

FIGS. 13A through 13D are diagrams each showing another example of the arrangement of sub-pixels.

DESCRIPTION OF AN EXEMPLARY EMBODIMENT

1. Configuration

Figure 1:
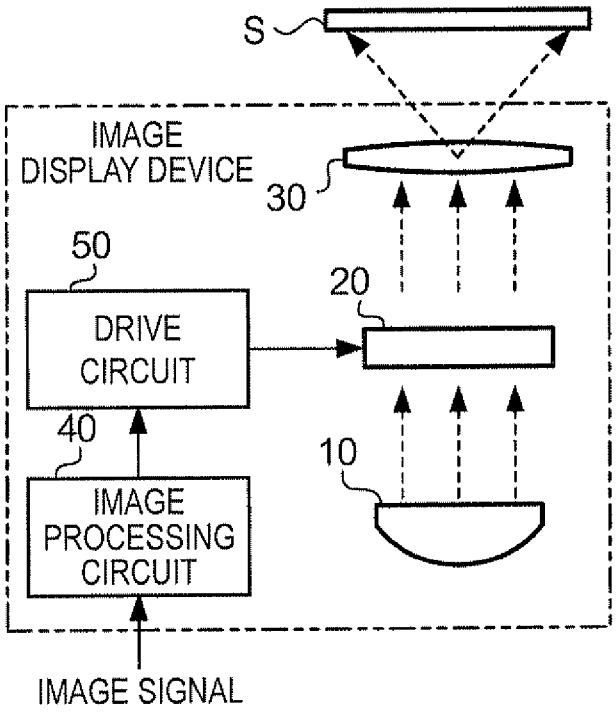
FIG. 1 is a diagram showing a configuration of a display device 1 according to an embodiment of the invention.

FIG. 1 is a diagram showing a configuration of a display device 1 according to an embodiment of the invention. In this example, the display device 1 is a projector for projecting an image, which corresponds to an image signal (a video signal) supplied from an external device, on a screen S. The display device 1 has a light source 10, a liquid crystal panel 20, a projection lens 30, an image processing circuit 40, and a drive circuit 50. The light source 10 is a light source of projection light, and has a light source device such as a super-high pressure mercury lamp or a metal halide lamp. The liquid crystal panel 20 is a light modulation device (a light valve) for modulating the light emitted from the light source 10. In this example, the liquid crystal panel 20 is a transmissive panel, and has a liquid crystal encapsulated between a pair of transparent electrodes. One of the transparent electrodes is sectioned into a plurality of pixels arranged in a matrix. The liquid crystal of each of the pixels exhibits an optical characteristic (e.g., the transmittance) corresponding to a voltage applied between the transparent electrodes. By controlling the voltage applied to each of the pixels, it is possible to modulate incident light pixel by pixel. In this example, the display device 1 is a single panel projector, and has the single liquid crystal panel 20.

Figure 2:
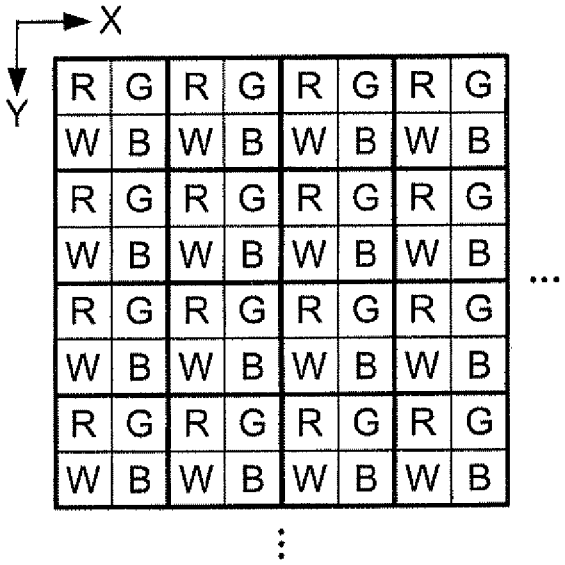
FIG. 2 is a diagram showing an arrangement of pixels in a liquid crystal panel 20.

FIG. 2 is a diagram showing an arrangement of the pixels in the liquid crystal panel 20. In the liquid crystal panel 20, a plurality of pixels are arranged two-dimensionally (in a matrix) in an X (row) direction and a Y (column) direction perpendicular to the X direction. In this example, the liquid crystal panel 20 has the pixels arranged in an m×n matrix (m×n pixels). Each of the pixels is composed of two sub-pixels adjacent to each other in the X direction and two sub-pixels, which are adjacent to each other in the X direction and adjacent respectively to the two sub-pixels in the Y direction, totally four sub-pixels arranged in a 2×2 matrix. In other words, the liquid crystal panel 20 has the sub-pixels arranged in a 2m×2n matrix (2m×2n sub-pixels). In each of the sub-pixels, the wavelength band of the light to be transmitted is controlled by a filter. The four sub-pixels transmit wavelength bands of red (R), green (G), blue (B), and white (W), respectively. Hereinafter, the sub-pixels transmitting R wavelength band are each referred to as a "sub-pixel R." The same applies to other colors.

In this example, the sub-pixel W and the sub-pixel R are adjacent to each other in the Y direction (an example of a second direction). The sub-pixel R and the sub-pixel G are adjacent to each other in the X direction (an example of a first direction). The sub-pixel G and the sub-pixel B are adjacent to each other in the Y direction. The sub-pixel B and the sub-pixel W are adjacent to each other in the X direction. In other words, the arrangement of the pixels of the liquid crystal panel 20 is obtained by replacing one of the two sub-pixels G in the Bayer arrangement with the sub-pixel W. Therefore, hereinafter the pixel arrangement is referred to as a "four-color Bayer arrangement" in some cases. It should be noted that white (a white color) in this case denotes a color including other three color components (R, G, and B) at a proportion higher than a predetermined level, and can be yellowish or grayish to some extent.

FIG. 1 is referred to again. The projection lens 30 enlarges an image formed by the light thus modulated by the liquid crystal panel 20, and projects the image thus enlarged on the screen S. The image processing circuit 40 performs predetermined image processing on the image signal input thereto. The image processing circuit 40 outputs the image signal on which the image processing has been performed to the drive circuit 50.

Figure 3:
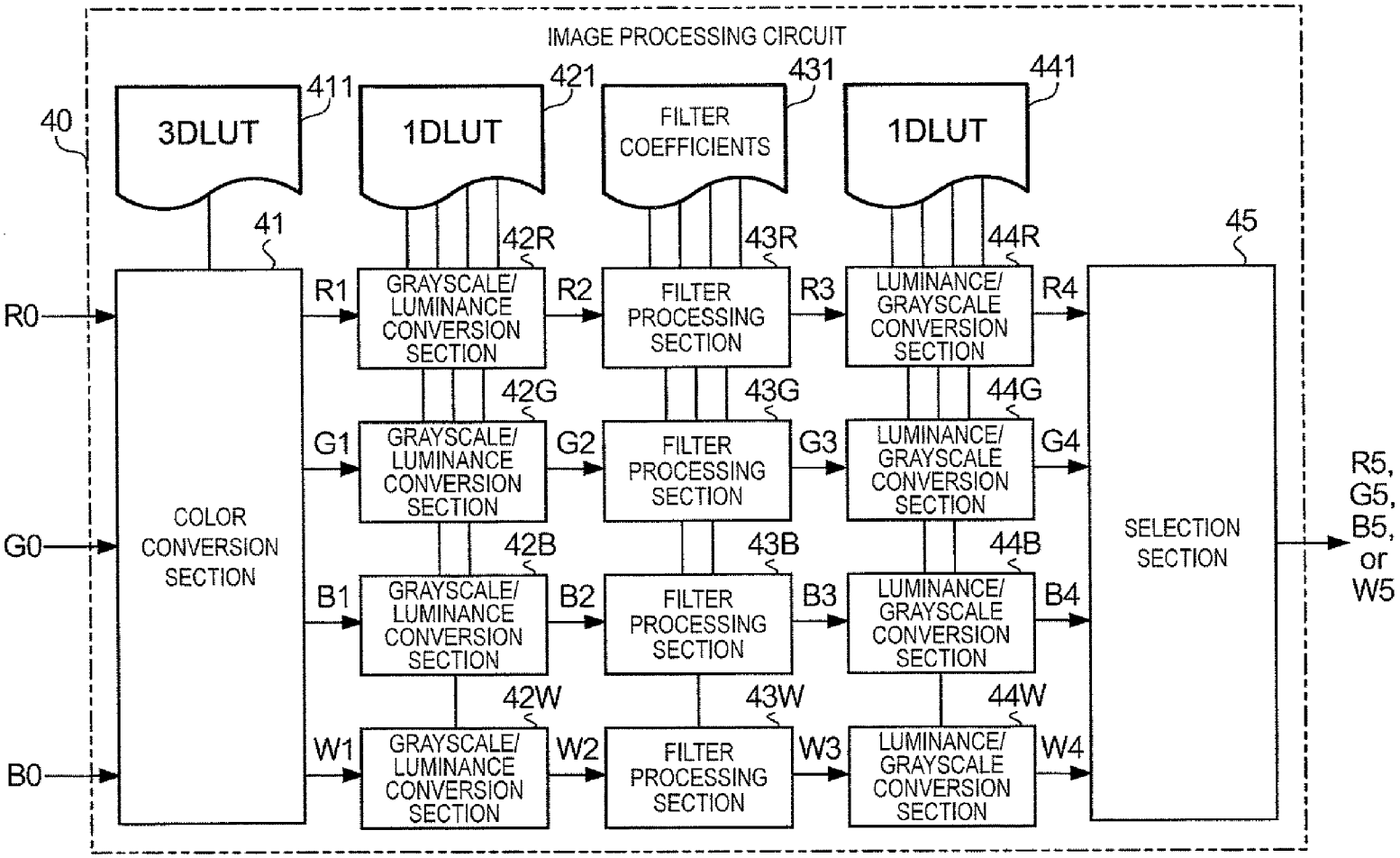
FIG. 3 is a diagram showing details of an image processing circuit 40.

FIG. 3 is a diagram showing the details of the image processing circuit 40 (an example of an image processing device). The image processing circuit 40 is a circuit for outputting a signal, which is obtained by performing the predetermined image processing on the input signals (the signals representing grayscale values of the three color components of R, G, and B in this example; hereinafter referred to as signals R0, G0, and B0, respectively), as an output signal. The image processing circuit 40 includes a color conversion section 41, grayscale/luminance conversion sections 42, filter processing sections 43, luminance/grayscale conversion sections 44, and a selection section 45. The color conversion section 41 and the selection section are each provided commonly to all of the color components, and the grayscale/luminance conversion sections 42, the filter processing sections 43, and the luminance/grayscale conversion sections 44 are provided independently for the respective color components, namely the number of the grayscale/luminance conversion sections 42 is four, the number of the filter processing sections 43 is four, and the number of the luminance/grayscale conversion sections 44 is four. In the case of discriminating one of the elements provided respectively for the color components from the rest, the discrimination is achieved by using a subscript such as "filter processing section 43R." In the case of not discriminating these elements, these elements are simply described as, for example, "filter processing sections 43."

The color conversion section 41 converts the signals R0, G0, and B0 into signals (the signals respectively representing the grayscale values of the four color components of R, G, B, and W in this example; hereinafter referred to as signals R1, G1, B1, and W1) of a color system compatible with the liquid crystal panel 20. This conversion is performed using a 3-dimensional look-up table (3DLUT) 411. The 3DLUT 411 is a table for making the grayscale values of the three color components of R, G, and B and the grayscale values of the four color components of R, G, B, and W correspond to each other. The 3DLUT 411 is prepared based on the correspondence relationship in color values (e.g., three indexes in the L*u*v* color system) between input signals Ri, Gi, and Bi and output signals Ro, Go, Bo, and Wo. In the case in which the correspondence relationship is not determined due to the difference in color reproduction area between the input signal and the output signal, the 3DLUT 411 is prepared using, for example, the method of gamut mapping used in the color reproduction between CRT and printers.

The grayscale/luminance conversion sections 42R, 42G, 42B, and 42W respectively convert the input signals R1, G1, B1, and W1 into signals R2, G2, B2, and W2, which are linear to the luminance in the liquid crystal panel 20. This conversion is performed using 1-dimensional look-up tables (1DLUT) 421R, 421G, 421B, and 421W. The 1DLUT 421 are prepared by measuring the grayscale-luminance characteristics with respect to the respective color components.

The filter processing sections 43R, 43G, 43B, and 43W limit the bands of the input signals R2, G2, B2, and W2, respectively. The filter processing sections 43R, 43G, 43B, and 43W output signals R3, G3, B3, and W3 with the bands thus limited, respectively. The filter processing is performed using filter coefficients 431R, 431G, 431B, and 431W. Details of the filter processing sections 43 will be described later.

The luminance/grayscale conversion sections 44R, 44G, 44B, and 44W convert the input signals R3, G3, B3, and W3 into signals R4, G4, B4, and W4 representing the grayscale values, respectively. The conversion is the inverse conversion of the conversion performed by the grayscale/luminance conversion sections 42. The conversion is performed using 1DLUT 441R, 441G, 441B, and 441W.

The selection section 45 (an example of an output section) performs a process of outputting a signal corresponding to selected one of the input signals R4, G4, B4, and W4 as a thinning process of reducing the number of pixels of the image represented by the input signals. The signal output when selecting the signal R4 is expressed as a signal R5. Similarly, the signals output when selecting the signals G4, B4, and W4 are expressed as signals G5, B5, and W5, respectively. The signal output by the selection section 45 at certain timing is either one of the signals R5, G5, B5, and W5. In this example, the number of pixels (the resolution) of the input signals R0, G0, and B0 input to the image processing circuit 40 is 4m×4n. In other words, the image represented by the input signals R0, G0, and B0 is composed of the pixels arranged in a 4m×4n matrix. On the other hand, the number of pixels of the liquid crystal panel 20 is m×n (the number of sub-pixels is 2m×2n). The selection section 45 decreases the number of pixels to a quarter thereof with respect to each of the row direction and the column direction.

The output signals R5, G5, B5, and W5 from the selection section 45 are supplied to the drive circuit 50. The drive circuit 50 generates a signal for driving the liquid crystal panel 20 in accordance with the signal supplied by the image processing circuit 40, and then outputs the signal thus generated to the liquid crystal panel 20.

2. Filter Characteristics

Then, the characteristics of the filters will be explained. Firstly, the characteristics of typical filters in the typical Bayer arrangement will be explained. Then, the characteristics of the filters according to a comparative example in the four-color Bayer arrangement will be explained. Finally, the characteristics of the filters in the filter processing sections 43 will be explained.

2-1. Filter Characteristics in Bayer Arrangement

Figure 4:
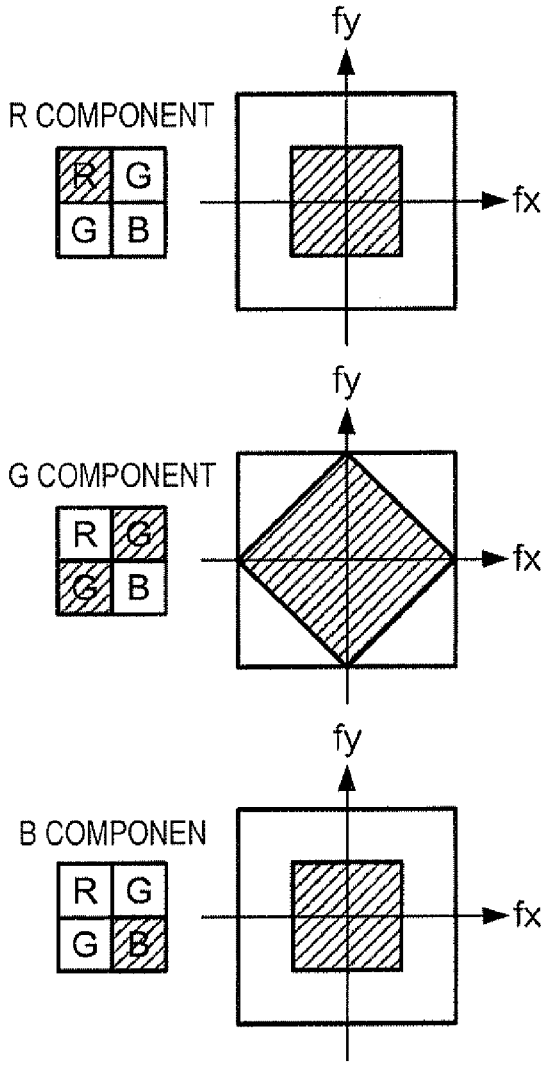
FIG. 4 is a diagram showing an example of the characteristics of filters in the Bayer arrangement.

FIG. 4 is a diagram showing an example of the characteristics of the filters in the Bayer arrangement. In FIG. 4, a horizontal axis represents a frequency fx in the X direction, and a vertical axis represents a frequency fy in the Y direction. The frequencies mentioned here are each a spatial frequency. In FIGS. 4A through 4C, outer squares indicated by solid lines each represent a frequency band in the input signal, and areas indicated by hatching each represent a passband of the filter.

In the R component and the B component, the band is limited to a half on the lower frequency side in both of the X direction and the Y direction compared to the input signal. This is because all of the three components of R, G, and B are included in each of the pixels in the input signal, while the sub-pixels R and the sub-pixels B are arranged alternately in both of the X direction and the Y direction in the Bayer arrangement. In other words, in the Bayer arrangement, with respect to the R component and the B component, the image can only be expressed with a number of pixels (the resolution), which is a half of the number of pixels of the input signal, in both of the X direction and the Y direction. Further, with respect to both of the R component and the B component, the area of the band of the output signal passing through the filter on an fx-fy plane is a quarter of that of the input signal.

On the other hand, with respect to the G component, since the two sub-pixels G exist in each of the pixels, the band to be limited is a half of those of the sub-pixel R and the sub-pixel B. In other words, with respect to the G component, the area of the band of the output signal passing through the filter on the fx-fy plane is two times as large as those of the R component and the B component (a half of that of the input signal). Specifically, regarding the G component, the band with higher frequencies is cut in both of the X direction and the Y direction with respect to the input signal. This operation can also be explained as follows.

Figure 5:
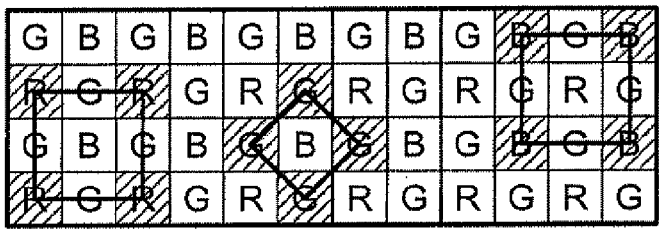
FIG. 5 is a diagram showing a grid formed of sub-pixels in the Bayer arrangement.

FIG. 5 is a diagram showing a grid formed by the sub-pixels in the Bayer arrangement. The grid (hereinafter referred to as a "grid G") formed by the sub-pixels G is a square with a side shorter than a side of the grid (hereinafter referred to as a "grid R/B") formed by the sub-pixels R (or the sub-pixels B), and is tilted 45° with respect to the grid R/B. The length of the side of the grid G is $\sqrt{2}/2$ (the value obtained by dividing the square root of 2 by 2) times as long as the side of the grid R/B. As described above, in the Bayer arrangement, the display with higher resolution can be achieved with respect to the G component than in the case of the R component and the B component. Therefore, it is possible to broaden the passband of the G signal than the passband of the R signal or the B signal. Since the G component has a higher spectral sensitivity in the human eyes compared to those of the R component and the B component, by arranging two sub-pixels G in each of the pixels, the visual resolution can be improved.

2-2. Filter Characteristics in Four-Color Bayer Arrangement

Comparative Example

Figure 6:
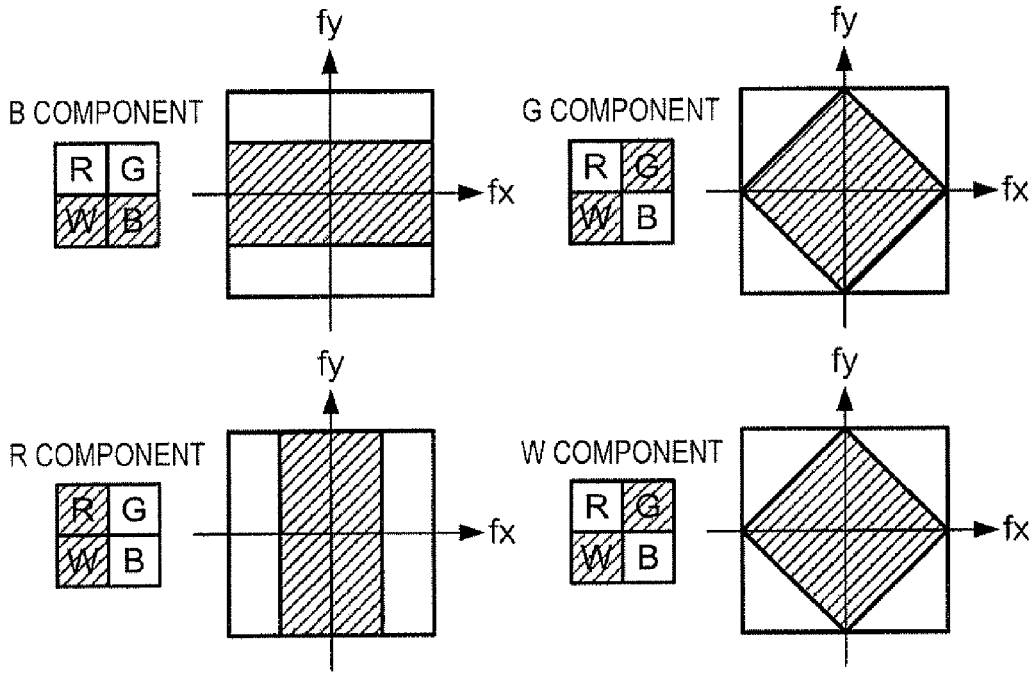
FIG. 6 is a diagram showing an example of the characteristics of filters according to a comparative example in the four-color Bayer arrangement.

FIG. 6 is a diagram showing an example of the characteristics of filters according to a comparative example in the four-color Bayer arrangement. Regarding the G component, the same band limitation as explained with reference to FIG. 4 is performed. Regarding the W component, the same band limitation as that of the G component is performed. Since the G component has the highest spectral sensitivity in the human eyes out of the R component, the G component, and the B component included in the sub-pixel W, the band limitation is performed assuming the sub-pixel Was the sub-pixel G. Then, regarding the B component, the band is limited to a half on the lower frequency side in the Y direction compared to the input signal. The band in the X direction is not limited. This is because all of the pixels include the B component in the input signal, while in the sub-pixel arrangement of the liquid crystal panel 20, the sub-pixels B are arranged in every other pixel in the Y direction, and either of the sub-pixel B and the sub-pixel W is arranged in every column in the X direction. Then, regarding the R component, the band is limited to a half on the lower frequency side in the X direction compared to the input signal. The band in the Y direction is not limited. This is because all of the pixels include the R component in the input signal, while in the sub-pixel arrangement of the liquid crystal panel 20, the sub-pixels R are arranged in every other pixel in the X direction, and either of the sub-pixel R and the sub-pixel W is arranged in every row in the Y direction.

Figure 7:
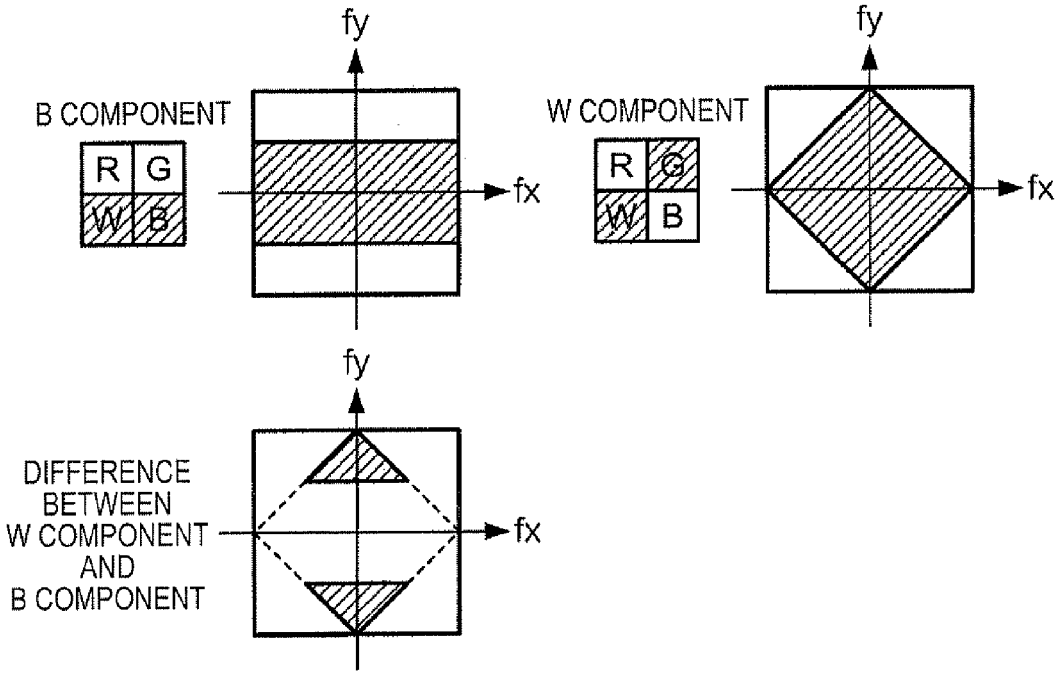
FIG. 7 is a diagram for explaining a problem of the comparative example.

FIG. 7 is a diagram for explaining a problem of the comparative example. Since the sub-pixel W includes not only the G component but also the R component and the B component, in some parts, the band limitation is different between the W component and the B component. For example, in FIG. 7, the bands in which the signal W is transmitted while the signal B is not transmitted are indicated by hatching. In this example, on the high frequency side in the Y direction, there exist the bands in which the signal W is transmitted while the signal B is not transmitted. In these bands, the moire due to the B component of the signal W occurs in some cases. The moire is caused by the B component, and is therefore viewed with some color (this phenomenon is called "false color"). The same applies to the R component. The filter processing sections 43 according to the present embodiment provide the filter processing for coping with this problem.

2-3. Filter Characteristics in Present Embodiment

Figure 8:
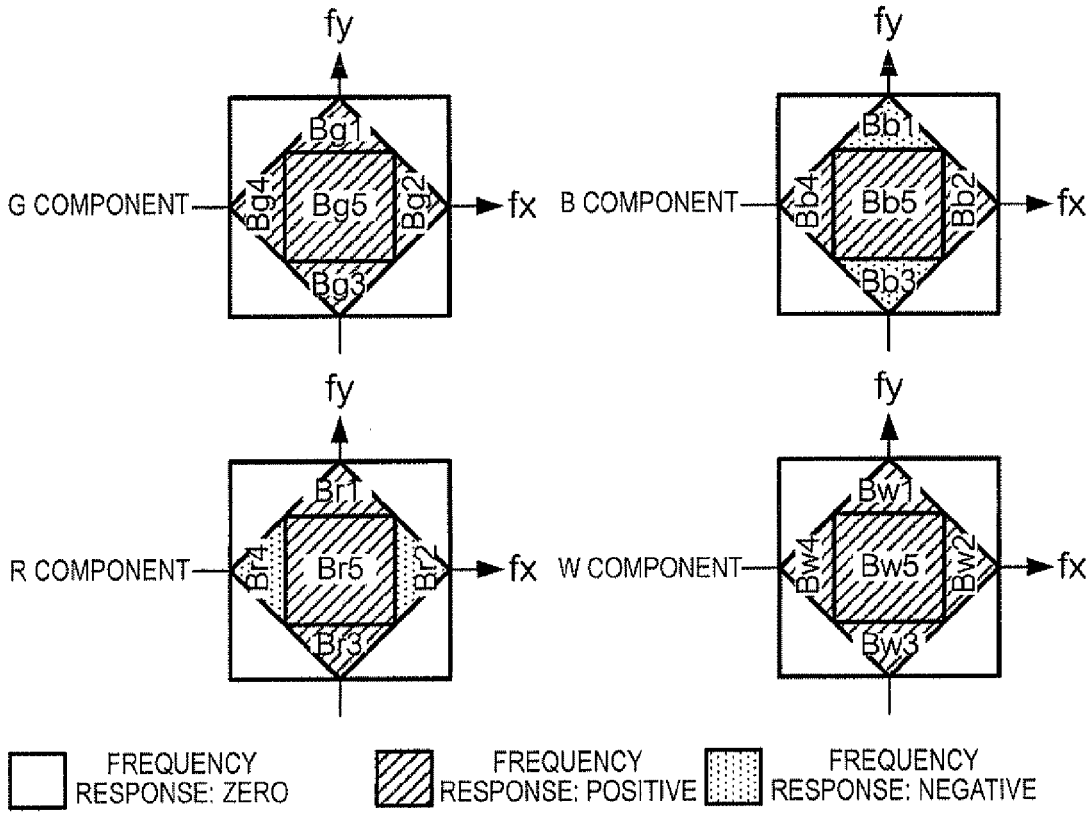
FIG. 8 is a diagram showing the characteristics of filter processing sections according to the present embodiment of the invention.

FIG. 8 is a diagram showing the characteristics of the filter processing sections 43 according to the present embodiment. In this example, all of the passbands of the filter processing sections 43R, 43G, 43B, and 43W are the same as in the filter characteristics of the G component shown in FIG. 4. It should be noted that a frequency response varies in accordance with the sub-pixel arrangement.

Firstly, regarding the W component, the same band limitation as that of the G component is performed. This is for the purpose of improving the visual resolution by assuming the sub-pixel W as the sub-pixel G as explained in the comparative example (FIG. 6). Regarding the R component and the B component, if the band limitation different from that in the W component is performed, the moire or the false color due to the different band limitation occurs in some cases as explained above, and therefore, the same band limitation as that in the W component is performed.

The filter processing sections 43 limit the frequency bands of the signals R, G, B, and W in the X direction and the Y direction in accordance with the positional relationship between the sub-pixels corresponding to each of the colors and the other sub-pixels. Further, the filter processing sections 43 adjust the frequency response of the image signals of the respective colors in accordance with the amplitude of the high frequency component of the image signal corresponding to each of the other colors. In this example, the filter characteristics of each of the components are sectioned into a plurality of areas. Regarding the R component, the characteristics are sectioned into five areas described below. The frequency response of each of the areas is also described in the parenthesis.

Area Br1: a high-frequency area in a Y positive direction (frequency response: positive)

Area Br2: a high-frequency area in an X positive direction (frequency response: negative)

Area Br3: a high-frequency area in a Y negative direction (frequency response: positive)

Area Br4: a high-frequency area in an X negative direction (frequency response: negative)

Area Br5: a low-frequency area in both the positive and negative directions of the X and Y directions (frequency response: positive)

Regarding the G component, the characteristics are sectioned into five areas described below.

Area Bg1: a high-frequency area in the Y positive direction (frequency response: positive)

Area Bg2: a high-frequency area in the X positive direction (frequency response: positive)

Area Bg3: a high-frequency area in the Y negative direction (frequency response: positive)

Area Bg4: a high-frequency area in the X negative direction (frequency response: positive)

Area Bg5: a low-frequency area in both the positive and negative directions of the X and Y directions (frequency response: positive)

Regarding the B component, the characteristics are sectioned into five areas described below.

Area Bb1: a high-frequency area in the Y positive direction (frequency response: negative)

Area Bb2: a high-frequency area in the X positive direction (frequency response: positive)

Area Bb3: a high-frequency area in the Y negative direction (frequency response: negative)

Area Bb4: a high-frequency area in the X negative direction (frequency response: positive)

Area Bb5: a low-frequency area in both the positive and negative directions of the X and Y directions (frequency response: positive)

Regarding the W component, the characteristics are sectioned into five areas described below.

Area Bw1: a high-frequency area in the Y positive direction (frequency response: positive)

Area Bw2: a high-frequency area in the X positive direction (frequency response: positive)

Area Bw3: a high-frequency area in the Y negative direction (frequency response: positive)

Area Bw4: a high-frequency area in the X negative direction (frequency response: positive)

Area Bw5: a low-frequency area in both the positive and negative directions of the X and Y directions (frequency response: positive)

It should be noted here that the low-frequency area denotes the area with the frequency equal to or lower than a half of the highest frequency of the input signal, and the high-frequency area denotes the area with the frequency higher than a half of the highest frequency of the input signal.

In this example, the frequency response in each of the areas are adjusted using the amplitude of the high-frequency component of each of the signals R, G, and B, and the amplitude of the high-frequency component of each of the R component, the G component, and the B component of the signal W.

Figure 9A:
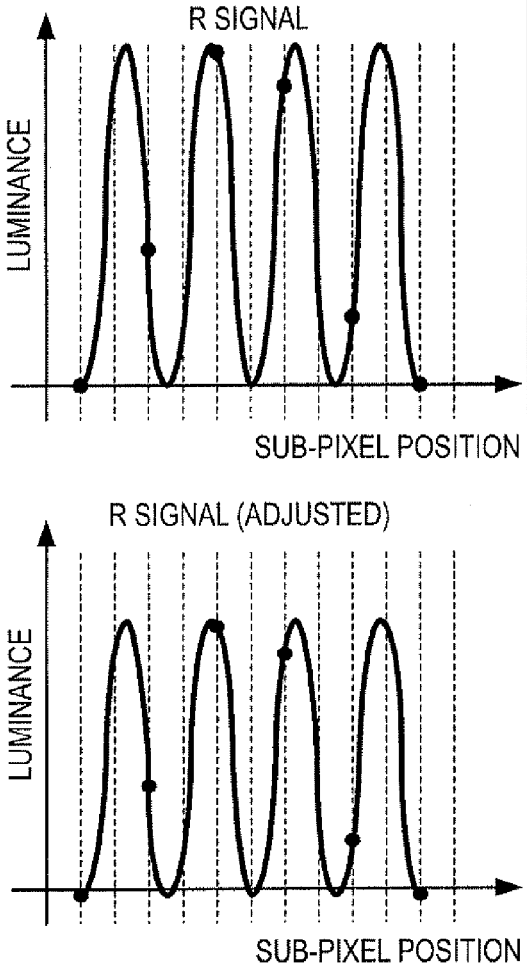
FIGS. 9A through 9C are diagrams for explaining a concept of an adjustment of a frequency response.
Figure 9B:
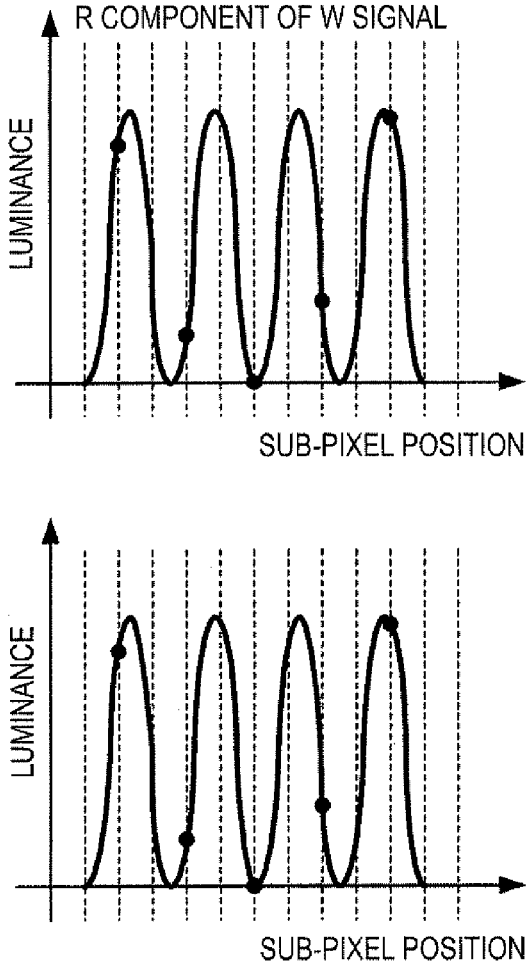
Figure 9C:
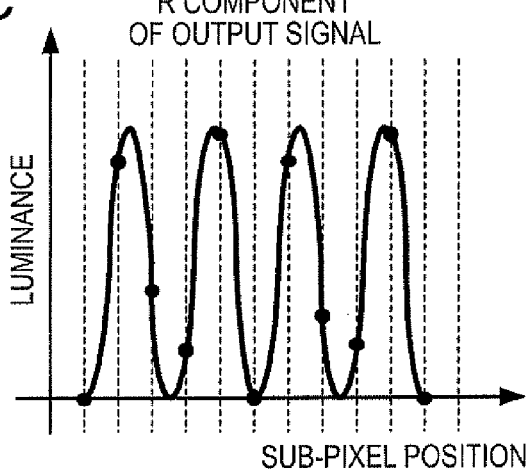

FIGS. 9A through 9C are diagrams for explaining a concept of the adjustment of the frequency response. Here, the areas Br1 and Br3 will be explained as an example. In FIGS. 9A through 9C, a horizontal axis represents the positions of the sub-pixels in the Y direction, and a vertical axis represents the luminance. A solid line shows the luminance characteristic represented by the input signal, and plotted dots each represent the luminance at each of the pixel positions. FIG. 9A shows the characteristics of the signal R, and FIG. 9B shows the characteristics of the R component of the signal W. Since the sub-pixel R and the sub-pixel W are located at respective positions different from each other in the Y direction, the plotted dots in FIG. 9A and the plotted dots in FIG. 9B are described at positions different from each other.

In each of FIGS. 9A and 9B, there occurs a low-frequency luminance variation (moire). Here, since the amplitude of the signal R and the amplitude of the R component of the signal W are different from each other (the amplitude of the signal R is larger than the amplitude of the R component of the signal W in this example), even if both of the amplitudes are simply added to each other, the moire fails to cancel out each other and remains.

Therefore, in the present embodiment, the amplitude of the signal R and the amplitude of the R component of the signal W are adjusted. Specifically, the adjustment is performed so as to fit the larger to the smaller. FIG. 9C is a diagram showing the characteristics of the image to be displayed on the liquid crystal panel 20. It is understood that the moire of the signal R and the moire of the R component of the signal W cancel out each other.

Figure 10A:
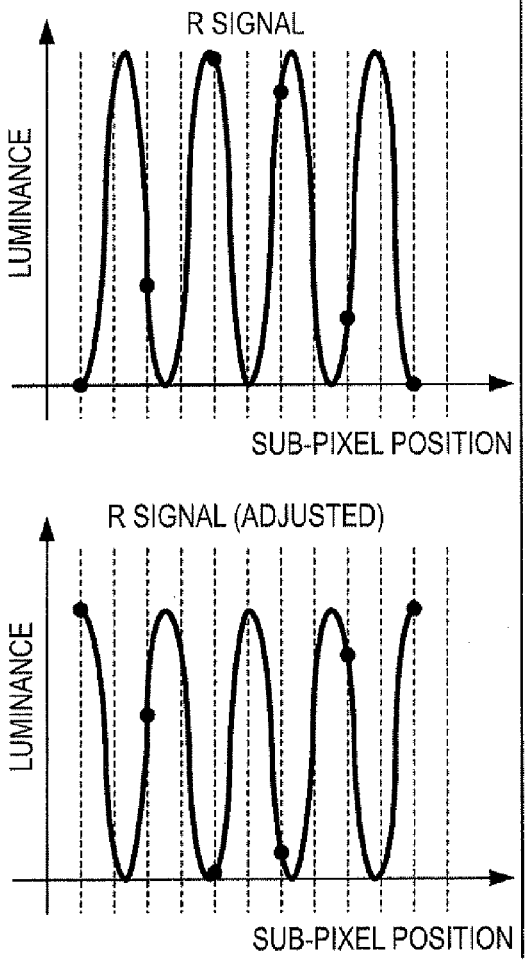
FIGS. 10A through 10C are other diagrams for explaining the concept of the adjustment of the frequency response.
Figure 10B:
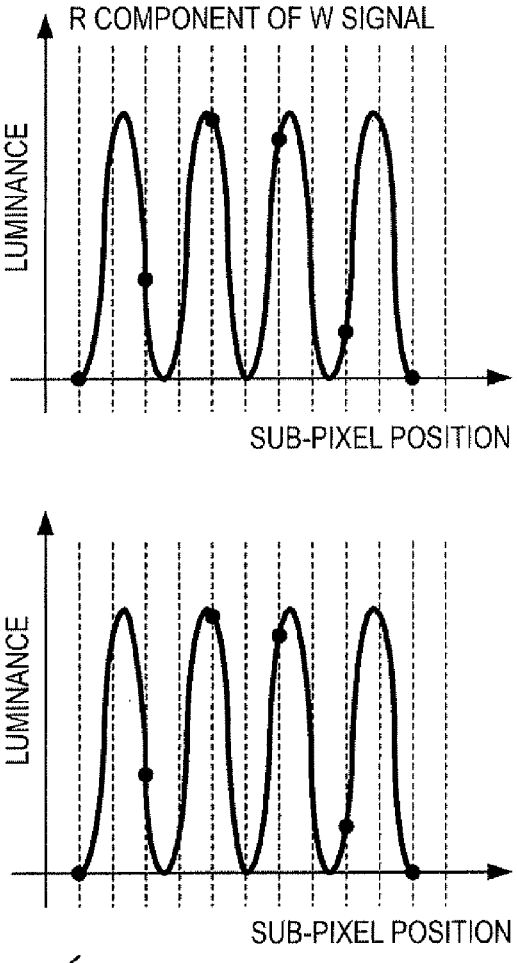
Figure 10C:
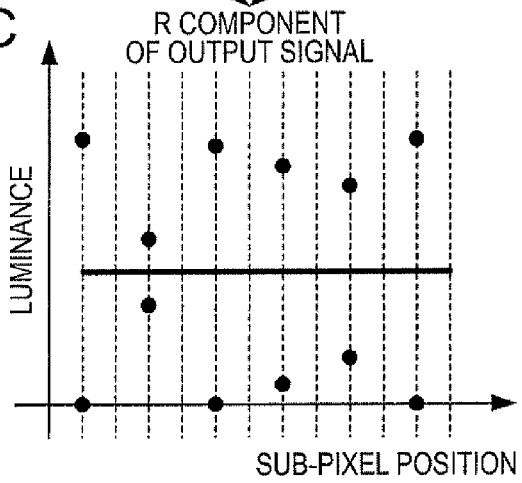

FIGS. 10A through 10C are other diagrams for explaining the concept of the adjustment of the frequency response. Here, the areas Br2 and Br4 will be explained as an example. In FIGS. 10A through 10C, a horizontal axis represents the positions of the sub-pixels in the X direction, and a vertical axis represents the luminance. A solid line shows the luminance characteristic represented by the input signal, and plotted dots each represent the luminance at each of the pixel positions. FIG. 10A shows the characteristics of the signal R, and FIG. 10B shows the characteristics of the R component of the signal W. Since the sub-pixel R and the sub-pixel Ware located at the same position in the X direction, the plotted dots in FIG. 10A and the plotted dots in FIG. 10B are described at the same positions.

In each of FIGS. 10A and 10B, there occurs a low-frequency luminance variation (moire). Firstly, since the plotted dots in the both drawings are located at the same positions, in order to make the moire cancel out each other, it is necessary to reverse a phase of either one of the waves. However, since the amplitude of the signal R and the amplitude of the R component of the signal Ware different from each other (the amplitude of the signal R is larger than the amplitude of the R component of the signal W in this example), even if both of the amplitudes are simply added to each other after reversing the phase of the one wave, the moire fails to cancel out each other and remains.

Therefore, in the present embodiment, the amplitude of the signal R and the amplitude of the R component of the signal W are adjusted. Specifically, the adjustment is performed so as to fit the larger to the smaller. FIG. 10C is a diagram showing the characteristics of the image to be displayed on the liquid crystal panel 20. It is understood that the moire of the signal R and the moire of the R component of the signal W cancel out each other.

The adjustment of the frequency response is specifically performed as follows. It should be noted that in the example described below, the adjustment is performed so that the occurrence of the moire in an achromatic color (gray) with which the moire and the false color are conspicuous can most efficiently be suppressed.

Firstly, proportions Wr, Wg, and Wb of the R, G, and B components included in the signal W are calculated using Formula (3) below.

$$\begin{pmatrix} Wr \\ Wg \\ Wb \end{pmatrix} = \begin{pmatrix} Xr & Xg & Xb \\ Yr & Yg & Yb \\ Zr & Zg & Zb \end{pmatrix}^{-1} \begin{pmatrix} Xw \\ Yw \\ Zw \end{pmatrix} \tag{3}$$

Here, X*, Y*, and Z* (*=r, g, b, and w) denote tristimulus values when signal values of the signals R, G, B and W take the maximum values (e.g., 4095 if the value is expressed in 12 bits).

Then, the amplitude of each of the R, G, and B components of each of the signals in the high-frequency component (2 pixels/cycle in this example) is calculated using Formula (4) below.

$$AR=R_{max}-R_{min}$$

$$AG=G_{max}-G_{min}$$

$$AB=B_{max}-B_{min}$$

$$ARw=(W_{max}-W_{min})\cdot Wr$$

$$AGw=(W_{max}-W_{min})\cdot Wg$$

$$ABw=(W_{max}-W_{min})\cdot Wb \tag{4}$$

Here, A* (*=R, G, B, Rw, Gw, and Bw) represent the amplitudes of the R, G, and B components of the signals, respectively. Further, *max (*=R, G, B, and W) are the signals R2, G2, B2, and W2, which are obtained by converting the input signals R0, G0, and B0 with the maximum values (e.g., 4095 if the values are expressed in 12 bits) into luminance-linear signals, respectively, and *min (*=R, G, B, and W) are the signals R2, G2, B2, and W2, which are obtained by converting the input signals R0, G0, and B0 with the minimum values (e.g., 0 if the values are expressed in 12 bits) into luminance-linear signals.

Then, a ratio RR between the amplitude of the R component of the R signal and the amplitude of the R component of the W signal is calculated using Formula (5) below. A ratio RG and a ratio RB are also calculated with respect to the G component and the B component in a similar manner.

$$RR=ARw/AR$$

$$RG=AGw/AG$$

$$RB=ABw/AB \tag{5}$$

Then, a gain of each of the signals R, G, B, and W is calculated using Formula (6) below.

Here, H* (*=R, G, B, and W) represent the gains of the respective signals.

$$HR=RR/\mathrm{Max}(RR,RG,RB,1)$$

$$HG=RG/\mathrm{Max}(RR,RG,RB,1)$$

$$HB=RB/\mathrm{Max}(RR,RG,RB,1)$$

$$HW=1/\mathrm{Max}(RR,RG,RB,1) \tag{6}$$

It should be noted that as is obvious from Formula (4), in this example, HR, HG, HB, and HW are each equal to or smaller than 1.

Frequency responses FRR, FRG, FRB, and FRW of the signals R, G, B, and W are determined as described below using the results described above.

The frequency response of the signal R
Areas Br1 and Br3: FRR=+HR
Areas Br2 and Br4: FRR=−HR
Area Br5: FRR=1
The frequency response of the signal G
Areas Bg1, Bg2, Bg3, and Bg4: FRG=+HG
Area Bg5: FRG=1
The frequency response of the signal B
Areas Bb1 and Bb3: FRB=−HB
Areas Bb1 and Bb4: FRB=+HB
Area Bb5: FRB=1
The frequency response of the signal W
Areas Bw1, Bw2, Bw3, and Bw4: FRW=+HW
Area Bw5: FRW=1

Figure 11A:
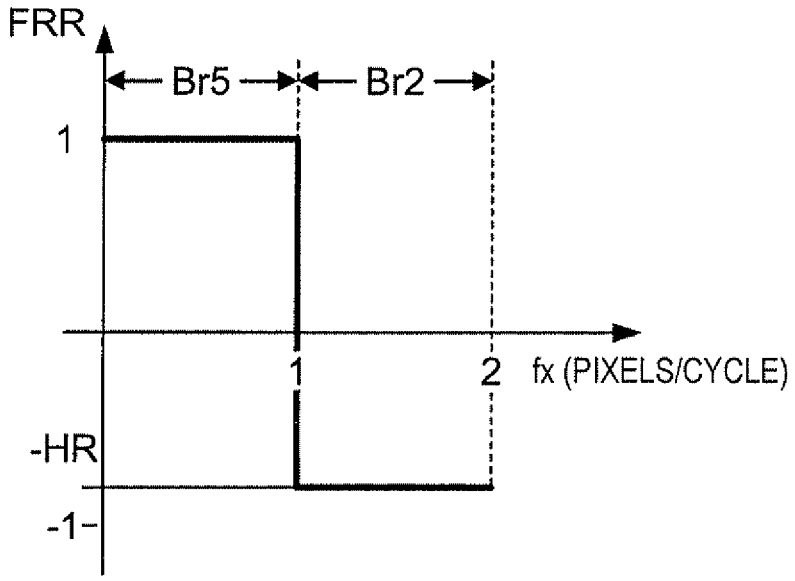
FIGS. 11A and 11B are diagrams showing an example of the ideal characteristics of the filter processing sections.
Figure 11B:
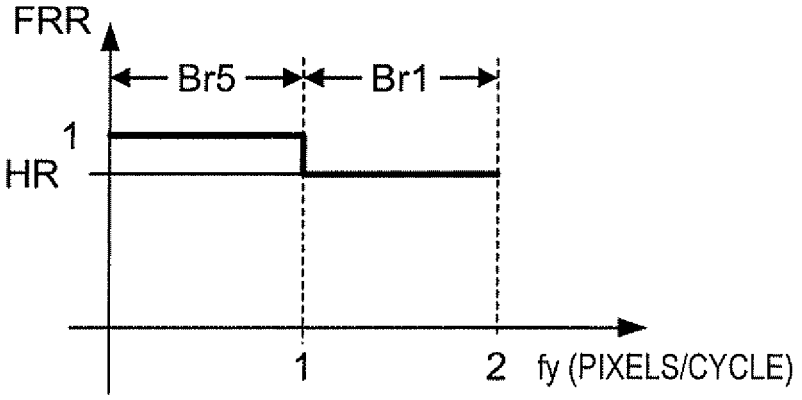

FIGS. 11A and 11B are diagrams showing an example of the ideal characteristics of the filter processing sections 43. FIG. 11A shows the characteristics of the frequency response FRR with respect to the frequency fx in the X direction in the case in which the frequency fy in the Y direction is fy=0, and FIG. 11B shows the characteristics of the frequency response FRR with respect to the frequency fy in the Y direction in the case in which the frequency fx in the X direction is fx=0. In FIG. 11A, a horizontal axis represents the frequency fx in the X direction, and in FIG. 11B, a horizontal axis represents the frequency fy in the Y direction. A vertical axis of each of the drawings represents the frequency response. In FIG. 11A, the area where the frequency is lower than 1 pixel/cycle (0.25 if expressed as the frequency normalized by the number of sub-pixels per cycle) corresponds to the area Br5, and the area where the frequency exceeds 1 pixel/cycle corresponds to the area Br2. In this example, in the area of $0 \leq fx \leq 1$, FRR=1 is obtained, and in the area of $1 \leq fx \leq 2$, FRR=−HR is obtained. Further, in the area of $0 \leq fy \leq 1$, FRR=1 is obtained, and in the area of $1 \leq fy \leq 2$, FRR=+HR ($\leq 1$) is obtained. It should be noted that the characteristics shown in FIGS. 11A and 11B only show the ideal characteristics, and the characteristics of the filter processing sections 43 are not necessarily required to completely coincide with the characteristics shown in FIGS. 11A and 11B as an example.

Figure 12:
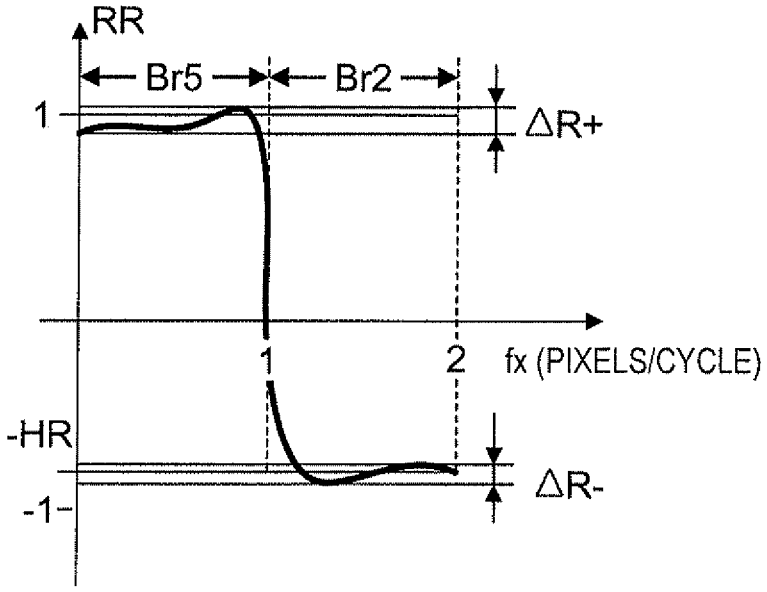
FIG. 12 is a diagram showing an example of the realistic characteristics of the filter processing sections.

FIG. 12 is a diagram showing an example of the realistic characteristics of the filter processing sections 43. The characteristics of the filter processing sections 43 are not required to completely coincide with the ideal characteristics providing the differences (e.g., ΔR+ and ΔR−) from the ideal frequency responses (e.g., 1 and −HR) fit into predetermined ranges respectively in a plurality of areas (e.g., the areas Br5 and Br2) defined by the frequencies in the X and Y directions. Further, in a predetermined area in the vicinity of the boundary between two (e.g., the areas Br5 and Br2) of the areas, it is not required for the frequency response to fit into the predetermined range described above.

3. Modified Examples

The invention is not limited to the embodiment described above, but can be put into practice with a variety of modifications. Hereinafter, some modified examples will be explained. It is also possible to use two or more of the modified examples described below in combination.

The arrangement of the pixels in the invention is not necessarily required to have the square shape as in the embodiment described above. For example, in the case in which the sub-pixels have a rectangular shape, the arrangement of the overall pixels also has a rectangular shape. Further, the first direction and the second direction are not necessarily required to have the orthogonal relationship, but sufficiently have an intersectional relationship. Specifically, any pixels can be adopted in the invention without regard to the specific shape thereof providing the pixels are each composed of four sub-pixels arranged in a 2×2 matrix forming a quadrilateral shape.

Further, the positional relationship of the sub-pixels in each of the pixels is not limited to those of the embodiment described above. In the pixels in the invention, the sub-pixels adjacent to each other can be different from those of the embodiment providing the sub-pixel (the sub-pixel G in the embodiments) on which the substantially the same band limitation as in the sub-pixel W is performed is located in the diagonal direction viewed from the sub-pixel W.

FIGS. 13A through 13D are diagrams each showing another example of the arrangement of the sub-pixels. The arrangement shown in FIG. 13A is obtained by interchanging the positions of the sub-pixel R and the sub-pixel B in the arrangement of the embodiment (see FIG. 2) described above. In this case, it is sufficient to make the filter process to the signal R substantially the same as the filter process performed on the signal B in the embodiment, and make the filter process to the signal B substantially the same as the filter process performed on the signal R in the embodiment. Further, the arrangement shown in FIG. 13B is obtained by interchanging the positions of the sub-pixel G and the sub-pixel W in the arrangement of the embodiment described above. In this case, the filter processes to the image signals of the respective colors are substantially the same as those in the embodiment. In addition, the arrangement of the sub-pixels can also be the arrangement obtained by rotating each of the positions around a point of symmetry or lines of symmetry as the examples shown in FIGS. 13C and 13D.

Figure 14A:
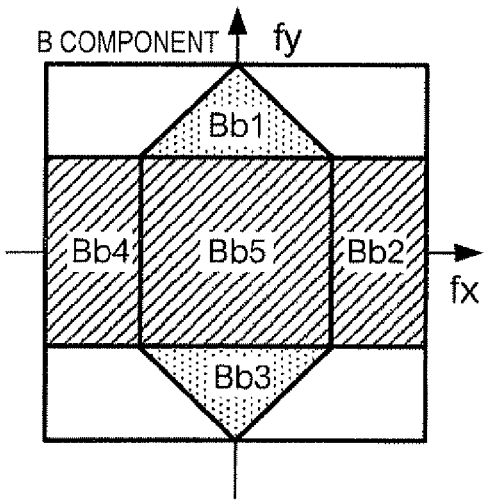
FIGS. 14A through 14C are diagrams each showing another example of band limitation in the filter processing sections.
Figure 14B:
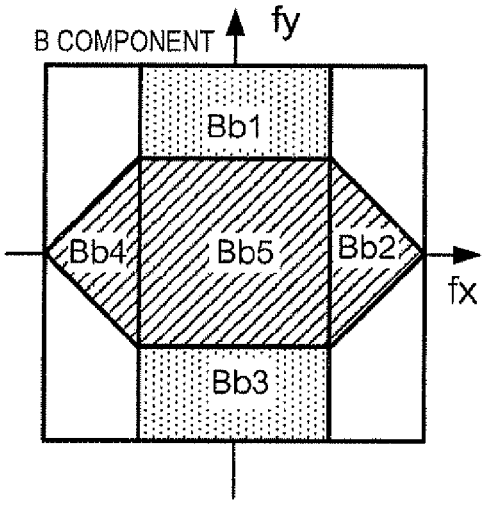
Figure 14C:
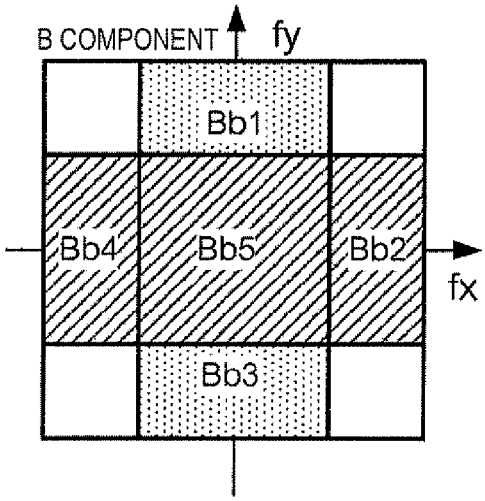
Figure 14C:
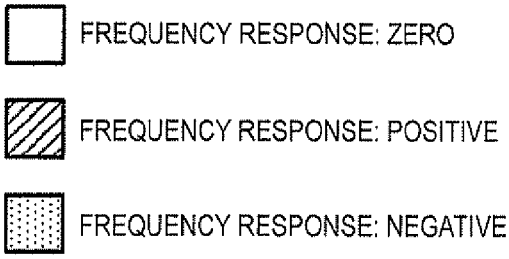

FIGS. 14A through 14C are diagrams each showing another example of band limitation in the filter processing sections 43. The band limitation in the filter processing sections 43 is not limited to that explained in the embodiment. Although in the embodiment, there is explained an example in which the shapes (the shapes of the parts where the frequency response is not equal to 0 in the fx-fy plane) of the band limitation with respect to all of the signals are the same, the shape of the band limitation to at least one signal can be different from the shape of the band limitation to another signal. FIGS. 14A through 14C each show an example of the band limitation in the filter processing section 43B. FIG. 14A shows an example obtained by modifying the characteristics shown in FIG. 8 so as not to perform the band limitation in the X direction. FIG. 14B shows an example obtained by modifying the characteristics shown in FIG. 8 so as not to perform the band limitation in the Y direction. FIG. 14C shows the characteristics obtained by combining the characteristics shown in FIGS. 14A and 14B. In these examples, although there occurs the area where the difference between the signal W and the signal R having passed through the filter fails to cancel out (fails to vanish), even in such a case, there is a case in which a high quality image can be obtained in the rest of the areas compared to the examples shown in FIGS. 6 and 7. It should be noted that the band limitation shown in FIGS. 8, and 14A through 14C only shows the ideal characteristics, and the characteristics of the filter processing sections 43 are not limited to those shown in FIGS. 8 and 14A through 14C. For example, the boundary line between the two areas is not limited to a straight line on the fx-fy plane, but can be a curve.

Further, in some cases, in the positional relationship between the sub-pixels of the respective colors in the arrangement of the sub-pixels, the sub-pixel W and the sub-pixel G are not necessarily required to be opposed to each other in the diagonal direction. For example, in the case of displaying a reddish image or an image including a high proportion of red, or in the case of intending to display red in a more eye-friendly manner than other colors, it is possible to set the sub-pixel R to the sub-pixel opposed to the sub-pixel W in the diagonal direction. In other words, it is possible to determine the arrangement of the sub-pixels taking the image to be displayed by the display device or the image quality required to the display device into consideration.

The display colors of the respective sub-pixels and the combination thereof are not limited to R, G, B, and W explained in the embodiment. It is also possible to use sub-pixels for displaying respective colors other than R, G, B, and W providing the sub-pixels respectively display first, second, third colors having the respective wavelength bands different from each other, and a fourth color including all of the components of the first through third colors.

The light modulator used in the display device 1 is not limited to the transmissive liquid crystal panel. A reflective liquid crystal panel, or a display panel of an organic electroluminescence (EL) display or a plasma display can also be used instead of the transmissive liquid crystal panel.

The display device 1 is not limited to a projector. The display device 1 can be a television set, a video tape recorder of a viewfinder type or a monitor direct-view type, a car navigation system, a pager, a personal digital assistance, an electronic calculator, a word processor, a workstation, a picture phone, a POS terminal, a digital still camera, a cellular phone, a tablet terminal, or a personal computer.

Further, the image processing device according to the invention can be realized by an image processing circuit incorporated in the display device, or can be realized by a software process performed by a computer device such as a personal computer. Further, the invention can also be provided in the form of an image processing method of performing the image processing corresponding to each of the four colors, a program for making the computer device perform the image processing, and a recording medium on which the program is recorded.

What is claimed is:

1. An image processing device comprising:

an output section adapted to output an image signal to a display device having a plurality of pixels each including four sub-pixels constituted by a first sub-pixel, a second sub-pixel, a third sub-pixel, and a fourth sub-pixel corresponding respectively to a first color, a second color, a third color, and a fourth color different from each other, the first and second sub-pixels being adjacent to each other in a first direction, the second and third sub-pixels being adjacent to each other in a second direction intersecting with the first direction, the third and fourth sub-pixels being adjacent to each other in the first direction, the fourth and first sub-pixels being adjacent to each other in the second direction, and the first color including components of the second, third, and fourth colors;

a first filter section adapted to limit frequency bands in the first and second directions of a first image signal corresponding to the first color in each of the pixels in accordance with a positional relationship between the first and third sub-pixels, and adjust a frequency response of the first image signal in accordance with amplitudes of high-frequency components of image signals corresponding respectively to the second, third, and fourth colors, and amplitudes of the second, third, and fourth color components of a high-frequency component of the first image signal;

a second filter section adapted to limit frequency bands in the first and second directions of a second image signal representing a grayscale value of the second sub-pixel in each of the pixels in accordance with a positional relationship between the first and second sub-pixels, and adjust a frequency response of the second image signal in accordance with the amplitudes of the high-frequency components of the image signals corresponding respectively to the second, third, and fourth colors, and the amplitudes of the second, third, and fourth color components of the high-frequency component of the first image signal;

a third filter section adapted to limit frequency bands in the first and second directions of a third image signal representing a grayscale value of the third sub-pixel in each of the pixels in accordance with the positional relationship between the first and third sub-pixels, and adjust a frequency response of the third image signal in accordance with the amplitudes of the high-frequency components of the image signals corresponding respectively to the second, third, and fourth colors, and the amplitudes of the second, third, and fourth color components of the high-frequency component of the first image signal; and a fourth filter section adapted to limit frequency bands in the first and second directions of a fourth image signal representing a grayscale value of the fourth sub-pixel in each of the pixels in accordance with a positional relationship between the first and fourth sub-pixels, and adjust a frequency response of the fourth image signal in accordance with the amplitudes of the high-frequency components of the image signals corresponding respectively to the second, third, and fourth colors, and the amplitudes of the second, third, and fourth color components of the high-frequency component of the first image signal, wherein the first, second, third, and fourth filter sections have a frequency response in common in a predetermined low-frequency band in each of the first and second directions.

2. The image processing device according to claim 1, wherein the second filter section adjusts the frequency response of the second image signal so as to be different between the first direction and the second direction in a high-frequency band.

3. The image processing device according to claim 2, wherein the second filter section adjusts the frequency response of the second image signal so as to be positive in the high-frequency band in the first direction, and negative in the high-frequency band in the second direction.

4. The image processing device according to claim 1, wherein the fourth filter section adjusts the frequency response of the fourth image signal so as to be different between the first direction and the second direction in a high-frequency band.

5. The image processing device according to claim 4, wherein the fourth filter section adjusts the frequency response of the fourth image signal so as to be negative in the high-frequency band in the first direction, and positive in the high-frequency band in the second direction.

6. The image processing device according to claim 1, wherein the first filter section adjusts the frequency response of the first image signal so as to be +H1 in a high-frequency band in the first and second directions, the second filter section adjusts the frequency response of the second image signal so as to be +H2 in a high-frequency band in the first direction, and −H2 in the high-frequency band in the second direction, the third filter section adjusts the frequency response of the third image signal so as to be +H3 in a high-frequency band in the first and second directions, the fourth filter section adjusts the frequency response of the fourth image signal so as to be −H4 in the high-frequency band in the first direction, and +H4 in the high-frequency band in the second direction, $$H1=1/\mathrm{Max}(R2,R3,R4,1)$$

$$H2=R2/\mathrm{Max}(R2,R3,R4,1)$$

$$H3=R3/\mathrm{Max}(R2,R3,R4,1)$$

$$H4=R4/\mathrm{Max}(R2,R3,R4,1) \quad (1)$$

in the formula, R2, R3, and R4 are parameters determined by Formula (2):

$$R2A21/A2$$

$$R3=A31/A3$$

$$R4=A41/A4 \quad (2)$$

in the formula, A2, A3, and A4 respectively represent the amplitudes in a high-frequency band of the second, third, and fourth colors, and A21, A31, and A41 respectively represent the amplitudes of the second, third, and fourth color components of the first color.

7. The image processing device according to claim 1, wherein the amplitudes of the high-frequency components are each an amplitude at a frequency of 2 pixels/cycle.

8. The image processing device according to claim 1, wherein the common frequency response is 1.

9. A display device comprising:

a display section having a plurality of pixels each including four sub-pixels constituted by a first sub-pixel, a second sub-pixel, a third sub-pixel, and a fourth sub-pixel corresponding respectively to a first color, a second color, a third color, and a fourth color different from each other, the first and second sub-pixels being adjacent to each other in a first direction, the second and third sub-pixels being adjacent to each other in a second direction intersecting with the first direction, the third and fourth sub-pixels being adjacent to each other in the first direction, the fourth and first sub-pixels being adjacent to each other in the second direction, and the first color including components of the second, third, and fourth colors;

an output section adapted to output an image signal to the display section;

a first filter section adapted to limit frequency bands in the first and second directions of a first image signal corresponding to the first color in each of the pixels in accordance with a positional relationship between the first and third sub-pixels, and adjust a frequency response of the first image signal in accordance with amplitudes of high-frequency components of image signals corresponding respectively to the second, third, and fourth colors, and amplitudes of the second, third, and fourth color components of a high-frequency component of the first image signal;

a second filter section adapted to limit frequency bands in the first and second directions of a second image signal representing a grayscale value of the second sub-pixel in each of the pixels in accordance with a positional relationship between the first and second sub-pixels, and adjust a frequency response of the second image signal in accordance with the amplitudes of the high-frequency components of the image signals corresponding respectively to the second, third, and fourth colors, and the amplitudes of the second, third, and fourth color components of the high-frequency component of the first image signal;

a third filter section adapted to limit frequency bands in the first and second directions of a third image signal representing a grayscale value of the third sub-pixel in each of the pixels in accordance with the positional relationship between the first and third sub-pixels, and adjust a frequency response of the third image signal in accordance with the amplitudes of the high-frequency components of the image signals corresponding respectively to the second, third, and fourth colors, and the amplitudes of the second, third, and fourth color components of the high-frequency component of the first image signal; and a fourth filter section adapted to limit frequency bands in the first and second directions of a fourth image signal representing a grayscale value of the fourth sub-pixel in each of the pixels in accordance with a positional relationship between the first and fourth sub-pixels, and adjust a frequency response of the fourth image signal in accordance with the amplitudes of the high-frequency components of the image signals corresponding respectively to the second, third, and fourth colors, and the amplitudes of the second, third, and fourth color components of the high-frequency component of the first image signal, wherein the first, second, third, and fourth filter sections have a frequency response in common in a predetermined low-frequency band in each of the first and second directions.

10. An image processing method comprising:

outputting, by an output section, an image signal to a display device having a plurality of pixels each including four sub-pixels constituted by a first sub-pixel, a second sub-pixel, a third sub-pixel, and a fourth sub-pixel corresponding respectively to a first color, a second color, a third color, and a fourth color different from each other, the first and second sub-pixels being adjacent to each other in a first direction, the second and third sub-pixels being adjacent to each other in a second direction intersecting with the first direction, the third and fourth sub-pixels being adjacent to each other in the first direction, the fourth and first sub-pixels being adjacent to each other in the second direction, and the first color including components of the second, third, and fourth colors;

limiting, by a first filter section, frequency bands in the first and second directions of a first image signal corresponding to the first color in each of the pixels in accordance with a positional relationship between the first and third sub-pixels, and adjusting a frequency response of the first image signal in accordance with amplitudes of high-frequency components of image signals corresponding respectively to the second, third, and fourth colors, and amplitudes of the second, third, and fourth color components of a high-frequency component of the first image signal;

limiting, by a second filter section, frequency bands in the first and second directions of a second image signal representing a grayscale value of the second sub-pixel in each of the pixels in accordance with a positional relationship between the first and second sub-pixels, and adjusting a frequency response of the second image signal in accordance with the amplitudes of the high-frequency components of the image signals corresponding respectively to the second, third, and fourth colors, and the amplitudes of the second, third, and fourth color components of the high-frequency component of the first image signal;

limiting, by a third filter section, frequency bands in the first and second directions of a third image signal representing a grayscale value of the third sub-pixel in each of the pixels in accordance with the positional relationship between the first and third sub-pixels, and adjusting a frequency response of the third image signal in accordance with the amplitudes of the high-frequency components of the image signals corresponding respectively to the second, third, and fourth colors, and the amplitudes of the second, third, and fourth color components of the high-frequency component of the first image signal; and limiting, by a fourth filter section, frequency bands in the first and second directions of a fourth image signal representing a grayscale value of the fourth sub-pixel in each of the pixels in accordance with a positional relationship between the first and fourth sub-pixels, and adjusting a frequency response of the fourth image signal in accordance with the amplitudes of the high-frequency components of the image signals corresponding respectively to the second, third, and fourth colors, and the amplitudes of the second, third, and fourth color components of the high-frequency component of the first image signal, wherein the first, second, third, and fourth filter sections have a frequency response in common in a predetermined low-frequency band in each of the first and second directions.

* * * * *